United States Patent [19]

Van Soest

[11] Patent Number: 5,072,926

[45] Date of Patent: Dec. 17, 1991

[54] DEVICE FOR CONVEYING AND POSITIONING SHEETS

[75] Inventor: Hendrikus J. J. Van Soest, Helden, Netherlands

[73] Assignee: Oce Nederland B.V., Netherlands

[21] Appl. No.: 508,956

[22] Filed: Apr. 12, 1990

[30] Foreign Application Priority Data

Apr. 25, 1989 [NL] Netherlands ..... 8901034

[51] Int. Cl.[5] ..... B65H 9/06

[52] U.S. Cl. ..... 271/236; 271/245; 271/250; 271/227

[58] Field of Search ..... 271/227, 236, 245, 250

[56] References Cited

U.S. PATENT DOCUMENTS

| | | | |
|---|---|---|---|
| 1,951,901 | 3/1934 | Cottrell . | |
| 3,065,835 | 11/1962 | Drillick | 271/227 X |
| 3,240.487 | 3/1966 | Templeton . | |
| 4,245,836 | 1/1981 | Joosten | 271/236 X |

FOREIGN PATENT DOCUMENTS 63-171749 7/1988 Japan .

*Primary Examiner*—Richard A. Schacher
*Attorney, Agent, or Firm*—Reed, Smith, Shaw & McClay

[57] ABSTRACT

A device for conveying and positioning sheets, comprising positioning apparatus for positioning one of the longitudinal sides of the sheets on the ideal transport line for said longitudinal side, the positioning apparatus being adapted to occupy an operative or an inoperative position, and actuating apparatus for moving the positioning apparatus, the positioning apparatus comprising a first conveying device and a second conveying device, each comprising two conveying members, at least one of which is formed by a roller, which two conveying members can form a transport nip extending parallel to the ideal transport line, the transport nip of the first conveying device extending along the ideal transport line and the second conveying device being situated at some distance from the first conveying device in the zone of the sheet conveying path, and drive apparatus are provided by which the roller (or rollers) of each conveying device can be so driven that each conveying device in its operative position exerts on the sheets a force which is directed towards the other conveying device. The effect of this is that one of the longitudinal sides of a sheet is positioned on the ideal transport line for the longitudinal side irrespective of whether the sheet is fed diverging to either side from the ideal transport line, the lateral abutment being formed by the transport nip of the first conveying device.

4 Claims, 3 Drawing Sheets

DEVICE FOR CONVEYING AND POSITIONING SHEETS

FIELD OF THE INVENTION

The invention relates to a device for conveying and positioning sheets, specifically sheets of copy paper, used in a copying machine.

BACKGROUND OF THE INVENTION

In present-day copying machines, which offer double-sided and other modes of copying, it is often necessary that the sheets of copy paper change directions several times within the machine. Such changes in direction as well as mechanical tolerances, often result in the sheet falling outside the preferred zone of positionment, defined by an ideal transport line. A device for conveying and positioning sheets is described in U.S. Pat. No. 1,951,901, wherein the positioning means comprise a pair of rollers for moving the sheets perpendicularly relative to the direction of transport and a detection device on the ideal transport line for one of the longitudinal sides of the sheets. After the leading edge of a sheet has been aligned against a number of abutments, the pair of positioning rollers is brought into the operative position to move the sheet perpendicularly to the initial direction of transport. As soon as the detection device detects one of the longitudinal sides of the sheet, the pair of positioning rollers is set to the inoperative position via a control circuit so that the movement is stopped. The disadvantage of this device is that it is possible to position the sheet to the ideal transport path from only one direction. When the sheet supplied has one of the longitudinal sides already past the ideal transport line for that longitudinal side (relative to the transport path), it is no longer possible to correct this deviation using the positioning device described in U.S. Pat. No. 1,951,901.

In addition, positioning sheets by reference to a detected position is not satisfactorily accurate, since fluctuations in switching of positioning rollers into and out of operation, response times in the control system, and mass inertia, both of the components and the sheet, cause inaccuracies.

Another example of prior sheet aligning mechanisms is described in U.S. Pat. No. 3,240,487. This device, however, does not provide a means for positioning one side of a sheet along an ideal transport line. Similar devices include Japanese Patent Application Nos. 63-171748 and 63-171749. It would be desirable, therefore, to provide a device for conveying and positioning a sheet that does not have the above-described disadvantages, and permits positioning of a sheet that strays to either side of the ideal transport line.

SUMMARY OF THE INVENTION

The present invention solves the disadvantages of the prior art by providing a device having positioning means comprising a first conveying device and a second conveying device, each comprising two conveying members, at least one of which is formed by a roller, which two conveying members can form a transport nip which extends parallel to the ideal transport line, the transport nip of the first conveying device extending along the ideal transport line and the second conveying device being situated at some distance from the first conveying device in the zone of the sheet conveying path, and by providing drive means by which the roller (or rollers) of each conveying device can be so driven that each conveying device in its operative position exerts on the sheets a force which is directed towards the other conveying device.

Thus, the invention comprises conveying means for the sheets, abutment means extending transversely of the direction of sheet transport, positioning means for moving the sheets in a direction perpendicular to the direction of transport in order to position one of the longitudinal sides of the sheets on the ideal transport line for said longitudinal side, the positioning means being adapted to occupy an operative or inoperative position, and actuating means for moving the positioning means from the operative position to the inoperative position or vice versa.

The effect of this is that one of the longitudinal sides of a sheet is positioned on the ideal transport line for said longitudinal side irrespective of the side of the ideal transport line from which the supplied sheet is diverging, the lateral abutment being formed by the transport nip of the first conveying device.

In one preferred embodiment of the device according to the present invention, the device is also provided with biasing means for the conveying device, which enable the conveying members to be pressed against one another in their operative position such that the ratio between the normal force of the first conveying device and the normal force of the second conveying device is greater than or equal to two.

Consequently, a sheet supplied diverging from the ideal transport path in such manner that it is engaged both by the transport nip of the first conveying device and by the transport nip of the second conveying device of the positioning means is brought into the correct position undamaged.

Since the normal force of the first conveying device is much greater than that of the second conveying device, the frictional force exerted by the first conveying device on the sheet will move the sheet, with a slip in the first instance, through the slightly biased nip of the second conveying device until the sheet leaves the nip of the first conveying device.

Subsequently only the second conveying device still exerts a force on the sheet, so that the latter is moved in the opposite direction as far as the abutment formed by the nip of the first conveying device.

In another preferred embodiment of the present invention control means are provided with which the actuating means for moving the first conveying device and the second conveying device from the inoperative position to the operative position or vice versa are controlled such that on the changeover from the inoperative position to the operative position the conveying members of the first conveying device engage one another before the conveying members of the second conveying device do so and on the changeover from the operative position to the inoperative position the conveying members of the first conveying device are held in engangement with one another longer than the conveying members of the second conveying device.

This embodiment is also intended to obviate sheet damage. Since the first conveying device is brought into the operative position before the second conveying device, a sheet for positioning has in most cases already left the nip of the first conveying device when the second conveying device comes into its operative position and exerts force on the sheet. With the reverse change of position this then takes place in the reverse sequence.

Other details, objects and advantages of the present invention will become apparent as the following description of the presently preferred embodiments of practicing the present invention proceeds.

BRIEF DESCRIPTION OF THE DRAWINGS

In the accompanying drawings, preferred embodiments of the present invention are illustrated wherein.

DETAILED DESCRIPTION OF THE INVENTION

Figure 1:
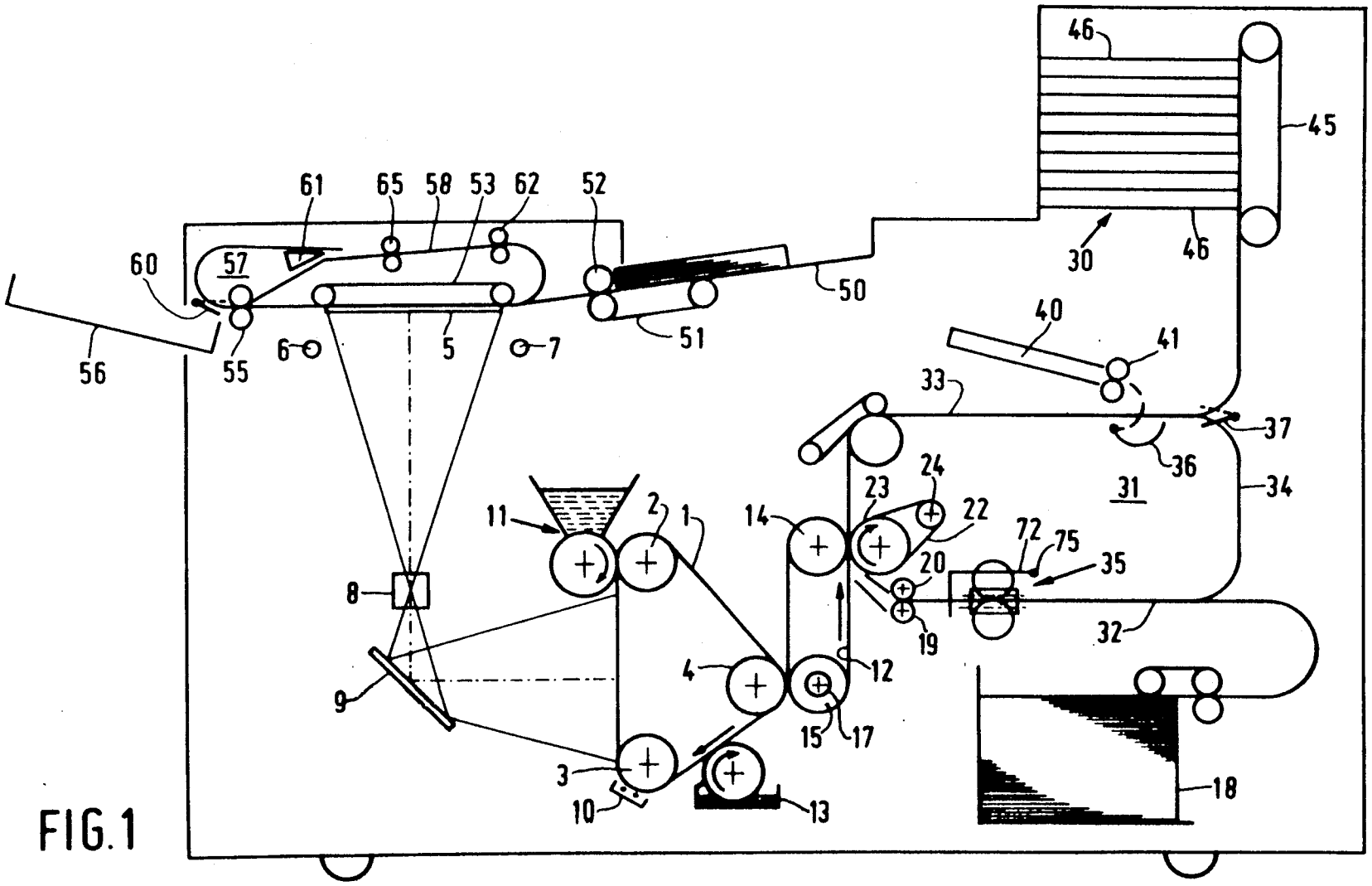
FIG. 1 is a cross-section of a copying machine in which the conveying and positioning device according to one preferred embodiment of the present invention is used.

The copying machine shown in FIG. 1 is provided with an endless photoconductive belt 1 which is advanced at a uniform speed by means of a series of drive or guide rollers 2, 3 and 4. The image of an original placed on a window 5 is projected onto the belt 1 by means of flashlights 6 and 7, a lens 8 and a mirror 9 after the belt has been electrostatically charged by a corona device 10.

The latent charge image formed on the belt 1 after the flash exposure is developed by a magnetic brush device 11 into a powder image which is then brought into contact, under pressure in a first transfer zone with an endless intermediate belt 12 made of or covered with soft resilient and heat-resistant material, e.g. silicone rubber.

In this situation the powder image is transferred by adhesion forces from the belt 1 to the belt 12. After this image transfer, any remaining image residues are removed from the belt 1 by a cleaning device 13, whereupon the belt 1 is ready for re-use. The belt 12 is trained about a pair of drive and guide rollers 14 and 15 and is heated by an infrared radiator 17 disposed inside the roller 15. While the belt 12 with the powder image thereon is advanced, the powder image becomes tacky as a result of the heating. In a second transfer zone formed by the belt 12 and a belt 22 trained about a pair of rollers 23 and 24 the tacky powder image is then transferred by pressure to, and simultaneously fixed on, a copy sheet fed from a reservoir 18 via a set of rollers 19 and 20. Finally, the resulting copy is deposited in a sorting device 30 or conversely returned to the second transfer zone via a duplex circuit 31 in order to additionally provide the rear side of the copy sheet with a powder image and hence make a double sided copy. The duplex circuit 31 is formed by part of a sheet supply path 32 extending from the reservoir 18 as far as the second transfer zone, a sheet discharge path 33, a return path 34 and a number of transport and guide means (not indicated) for the copy sheets in said transport paths. The duplex circuit 31 has a length such that it can contain a number of copy sheets one after the other, e.g., three such sheets. Also disposed in the duplex circuit 31 are a positioning device 35, which will be described in detail hereinafter, a switch 36 and a switch 37. In the position shown by a broken line, the switch 36 provides access to a turn-over path 40 via a reversible pair of transport rollers 41. A copy sheet deflected by the switch 36 is fed completely into the turn-over path 40 by the pair of rollers 41 and then fed back into the duplex circuit 31 after it has been turned over, the pair of rollers 41 rotating in the reverse direction. Simultaneously with the reversal of the direction of rotation of the pair of rollers 41 the switch 36 is set to the position which is shown by a solid line. The position of the switch 37 determines whether a copy sheet is conveyed to the sorting device 30 or via the return path 34 back to the second transfer zone.

In the solid-line position of the switch 37 a copy sheet printed on one side or both sides is fed to an endless conveyor belt 45 which can convey the copy sheet along sorting compartments 46. Deflecting elements (not shown) cooperate with each sorting compartment 46 to deposit the copy sheet in a sorting compartment 46 selected by the copying machine control system.

Originals are laid ready in feed tray 50 to be fed to the exposure station, the image side and, in the case of a doublesided original, the first image side, being turned face down.

Deposited originals are conveyed one by one to the exposure window 5 by means of a feed belt 51 and a separating roller 52 cooperating therewith. A conveyer belt 53 transports the original over the window 5 into the required position for exposure, and then discharges the original from the window 5, whereupon the original can be conveyed via a pair of rollers 55 to a receiving tray 56 or via a turn-over path 57 and a return path 58 back to the window 5.

A switch 60 is disposed directly behind the pair of rollers 55 and in the solid-line position feeds the original to the return path 58 while in the broken-line position it clears the path to the receiving tray 56.

Depending upon the copying mode selected the transport of originals and copysheets takes place in a specific way.

According to a first copying mode, in which a set of single-sided originals is copied to give a number of sets of copies printed on one side, the originals are fed to the window one by one and exposed the required number of times. The single-sided copies produced are deposited in the sorting device 30 such that a set of copies is formed in each sorting compartment 46. In this situation the switches 36 and 37 in the duplex circuit 31 are in the solid-line position while the switch 60 is in the broken-line position to deposit the originals, after the correct number of exposures, in the receiving tray 56.

When the copying machine is set to a second copying mode, a set of single-sided originals is copied to give a number of sets of copies printed on both sides. With this copying mode, the control system (not shown) of the copying machine sets the various switches in such manner that the following procedure can be carried out. A first original is placed on the window by means of the feed belt 51 and the conveyer belt 53 and exposed a number of times, e.g. three times. As a result, three images are formed on the photoconductive belt 1 and transferred via the intermediate belt 12 to and fixed on three copy sheets successively fed from the reservoir 18. The switches 36 and 37 are set by the control system to the brokenline positions to turn the copy sheets over in the turn-over path 40 and return them to the second transfer zone via the return path 34 and sheet feed path 32.

In the meantime, after the third exposure, the first original has been removed from the window via the conveyer belt 53 and conveyed via the pair of rollers 55, switch 60, and turn-over path 57, over a passive switch 61 to the return path 58, where the first original is stopped against the nip of a pair of rollers 62. At the same time, a second original is fed from the feed tray 50 to the window 5. The second original is also exposed three times, whereupon the developed powder images are transferred in the second transfer zone to the rear-sides of the copy sheets which have already been printed on one side and which have been fed turned-over via the duplex circuit 31. The copies now printed on both sides are again turned over via the turnover path 40 and conveyed via the switch 37 to the sorting device 30 where they are deposited in consecutive sorting compartments 46. The turning over of the copy sheets is necessary to ensure that the copies lie with the first image side face down in the sorting compartments 46. Continuation of this copying mode comprises repeating the above-described copying cycle with the first two originals until the required number of copies has been made. After the last exposure the originals are of course deposited in the receiving tray 56. This cycle is then also carried out with the next originals in the tandem mode described until all the originals of the set have been processed.

Finally, a third copying mode is intended to copy a set of double-sided originals to form copies printed on both sides. In this copying mode, the first original is placed with the first image side facing down on the window 5 and exposed so that a powder image of this original is formed and is transferred to a copy sheet.

The original is then removed from the window 5 and conveyed by the switch 60, which is in the solid-line position, to the return path 58 and stopped against the roller pair 62. A roller pair 65 in the return path 58 is then driven in the reverse direction so that the original is conveyed in the opposite direction to the switch 61 which discharges the original to the pair of rollers 55.

Thus the original is again brought to the return path 58 via switch 60 and turn-over path 57, the original being turned over and fed back to the window 5 with the second image side positioned face down so that this side can be exposed for copying.

The powder image then formed from this second image side is transferred to the rear side of the copy sheet, the front side of which has already been printed on, and this sheet is presented via duplex circuit 31 in the second transfer zone after first being turned over in the turn-over path 40.

The double-sided copy formed in this way is turned over in turn-over path 40 and conveyed by switch 37 to the sorting device 30 to be deposited with the first image side face down in one of the sorting compartments 46. The first original is conveyed in this way through the original conveyer path and exposed repeatedly until the required number of double-sided copies has been formed. After the last exposure of the second image side the original is again fed once through the turn-over path 57 and then via roller pair 55 deposited in the receiving tray 56 with the first image side positioned face down. The remaining originals of the set are then processed as described above to doublesided copies which are deposited in the sorting device 30 (in the correct orientation) as complete copy sets.

During the transport of the copy sheets through the duplex circuit 31 the sheet movement has been found to shift in a direction perpendicular to the direction of transport. Such shift which is caused, for example, by tolerances in respect of the correct position of the conveying and guide means (e.g. skewing, incorrect adjustment, wear) leads to deviations such that the second image side is no longer transferred to the copy sheet in the required position. The image comes too close to the side of the copy sheet or in extreme cases may even come partially outside the copy sheet. In order to correct such shifts of the position of copy sheets in the duplex circuit 31, a positioning device 35 is disposed just before the second transfer zone. This positioning device 35 is used both to position one of the longitudinal sides of a copy sheet on the ideal transport line for that longitudinal side and, to align the leading edge against the abutment means.

Figure 2:
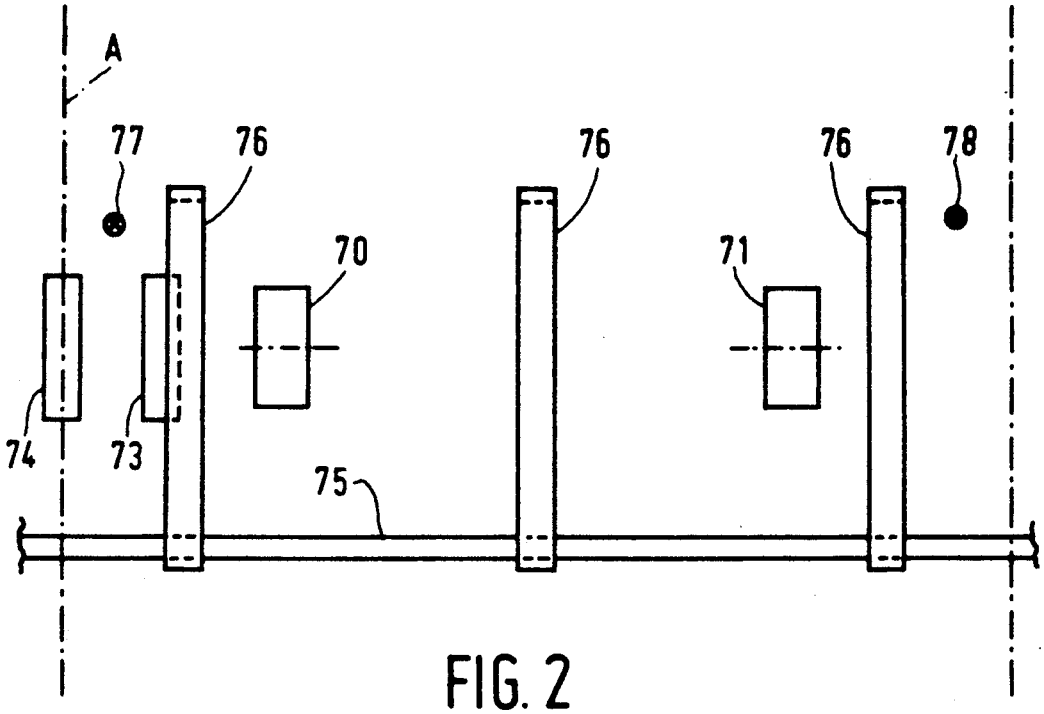
FIG. 2 is a top plan view of the conveying and positioning device of one preferred embodiment of the present invention.

As illustrated in FIGS. 1 and 2, the positioning device 35 consists of two pairs of transport rollers 70, 71 which convey the copy sheets to the second transfer zone, an abutment 72, a first pair of positioning rollers 73 and a second pair of positioning rollers 74. The abutment 72 is rotatable about a shaft 75 by means of a control mechanism such as a solenoid, between two extreme positions: a first position as illustrated in FIG. 1 in which the stop 72 is situated in the sheet feed path 32, and a second position in which the abutment 72 has been completely pivoted out of the feed path 32.

The abutment 72 is formed by a number of bent-over strips 76 distributed over the width of the conveyer path, but may alternatively consist of a plate or an element having the shape of a comb.

To prevent the leading edge of a copy sheet from being damaged against the abutment 72, the drive for the pairs of transport rollers 70, 71 is interrupted and the rollers are disengaged. The time at which the drive is interrupted and the rollers are disengaged is determined by a timing means, for example, from detectors 77 and 78 disposed just in front of the abutment 72 near the outsides of the conveyer path. As soon as a copy sheet has been fed by the pairs of transport rollers 70, 71 against the abutment 72, as indicated when the two detectors 77,78 are covered by the sheet, a signal is generated to interrupt the drive to the pairs of transport rollers 70, 71 and disengage the rollers.

From that moment on, the copy sheet is disengaged from any conveying means so that, in the direction perpendicular to the direction of conveyance, it can be brought in the correct position by the pairs of positioning rollers 73, 74, a longitudinal side of the copy sheet coming to lie on the ideal transport line for the sheet, denoted by A in FIG. 2. For this purpose, the pairs of rollers 73, 74, which are in an inoperative position during transport of the copy sheets, are brought into the operative position to perform a positioning cycle as described hereinafter with a reference to FIGS. 3 and 4.

After the positioning cycle has been carried out the abutment 72 is pivoted out of the conveying path and at the moment determined by the control system the pairs of transport rollers 70, 71 are brought back into the operative position to convey the copy sheet to the second transfer zone.

Instead of the above-described interruption to the drive and disengagement of the pairs of rollers 70, 71 during the positioning cycle, the biasing force for these pairs of rollers can be reduced to a very low level so that the copy sheet continues to lie between the rollers while slipping. The frictional forces on the copy sheets are then so slight that no damage occurs to the copy sheets. Another effect of this is that the copy sheet is held accurately against the abutment 72 during the entire positioning cycle.

FIGS. 3 and 4 show diagrammatically the stages of a positioning cycle for two different situations. FIGS. 3*a*–3*e* show the sequence of the cycle for a copy sheet fed with a deviation to the left of the ideal transport line A while FIGS. 4*a*–4*e* show the same for a copy sheet occupying a deviating position to the right of the ideal transport line A.

Figure 3A:
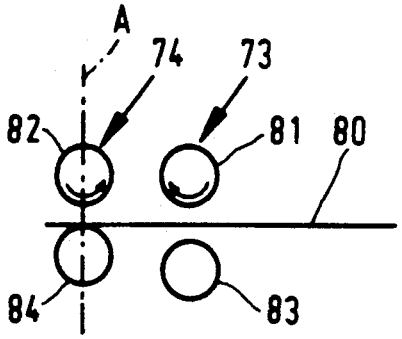
FIGS. 3*a* to 3*e* diagrammatically show the various stages of the cycle used to correct a first deviation of the position of a sheet in the device according to a preferred embodiment of the present invention.
Figure 3B:
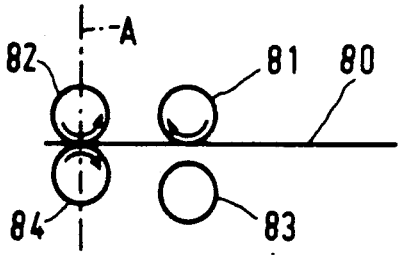
Figure 3C:
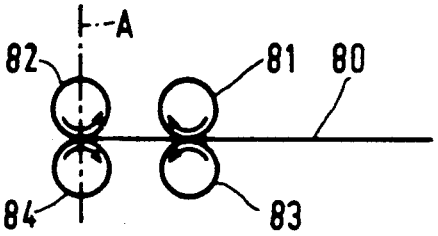
Figure 3D:
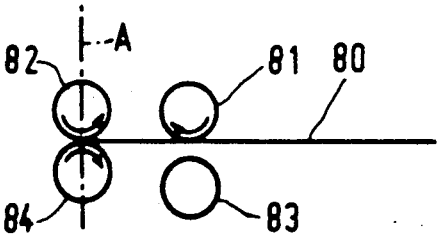

FIG. 3*a* shows the initial situation of a copy sheet 80 aligned against the abutment 72. Both the pairs of rollers consist of rollers 81, 82 driven by a drive means (not shown) and freely rotable rollers 83, 84. The rollers 81 and 82 are driven in opposite directions as shown by the arrows in the drawing.

Roller 84 is mounted in a fixed position in the copying machine while rollers 81, 82 and 83 can be set to a first or a second position.

In the first position the rollers of each pair of rollers 73, 74 are in engagement with one another (the operative position) and in the second position the rollers are disengaged so that the positioning means are inoperative.

Movement of the rollers between the different positions can be produced by actuating means known from the art, e.g. solenoids or pneumatic cylinders. Starting from the situation shown in FIG. 3*a* in which the rollers 81, 82 and 83 are in the second (inoperative) position the rollers 81 and 82 are first brought into the first position as will be apparent from FIG. 3*b*. As a result the driven roller 82 is pressed against roller 84 so that a frictional force is exerted on the copy sheet 80 in the nip between these rollers 82, 84 and causes the sheet 80 to move to the right until it moves out of the nip.

When the roller 83 is then also brought into the first position, this roller forms a nip with the driven roller 81 so that a frictional force to the left is exerted on the copy sheet 80. Consequently, the copy sheet 80 is moved to the left by the rollers 81, 83 and is aligned against the nip of the rotating rollers 82, 84 which tend to move the sheet 80 to the right. The result is that the left hand longitudinal side of the copy sheet 80 is positioned against the nip of the rollers 82,84 which is situated on the ideal transport line A (see FIG. 3*c*).

Figure 3E:
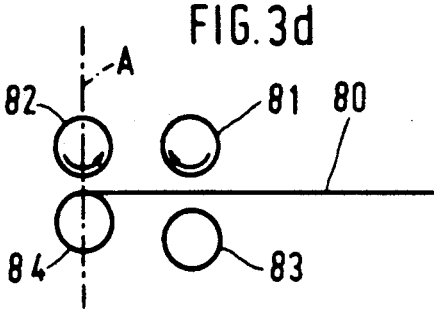

Once the required position of the copy sheet 80 has been reached roller 83 is first moved to the second position (FIG. 3*d*) and only then are the rollers 81 and 82 brought into their second position (FIG. 3*e*). This sequence is important because with the reverse sequence the pair of rollers 73 which are in engagement for a longer period would have an adverse effect on the position of the sheet 80.

From this time on, the copy sheet 80 is in the correct position ready for transport by the pairs of transport rollers 70,71 to the second transfer zone.

Since the displacement of the rollers 81,82 is synchronous, there is no need for separate actuating means to be used for the two rollers. A good solution, for example, is to place the rollers 81, 82 in a yoke and move the yoke between a first and second position.

Tolerances in the position of the supplied copy sheet 80 might cause the rollers 82 and 84 to incompletely release the copy sheet from their nip when the roller 83 engages the roller 81. This might result in damage to the copy sheet 80 or disturbance to the positioning. According to the invention, this is obviated by pressing the rollers of each pair 73 and 74 on one another with a different normal force in their operative position by actuating means known per se. The ratio between the normal force of the roller pair 74 and that of the roller pair 73 is for this purpose at least two, and preferably between 2.5 and 4. In this situation roller pair 74 can exert a frictional force on the copy sheet 80 so much greater that the copy sheet can be conveyed to the right while slipping in the nip of the roller pair 73.

When the ratio between the normal forces is in the preferred zone, it is even possible to bring the nips of the pairs of rollers 73 and 74 into the operative position simultaneously. In that case the copy sheet 80 is in the first instance conveyed to the right by roller pair 74 while slipping between the rollers 81 and 83. As soon as the copy sheet 80 tends to disengage from the nip of the pair of rollers 74 only then does the pair of rollers 73 exert force on the copy sheet so that it remains positioned to the left against the nip of the pair of rollers 74.

Figure 4A:
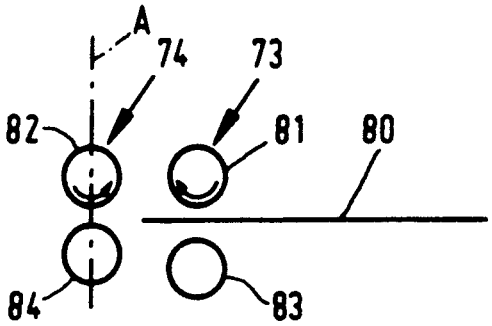
FIGS. 4*a* to 4*e* diagrammatically show the various stages of the cycle in which a preferred embodiment of the present invention corrects a second deviation of the position of a sheet, and FIG. 5 diagrammatically shows a second embodiment of the positioning device used in a device according to the invention.
Figure 4B:
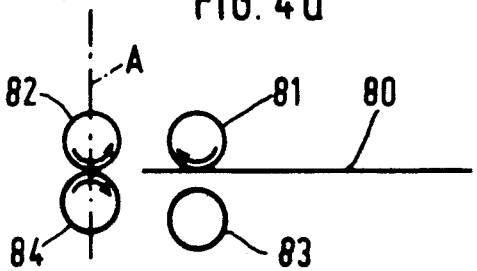
Figure 4C:
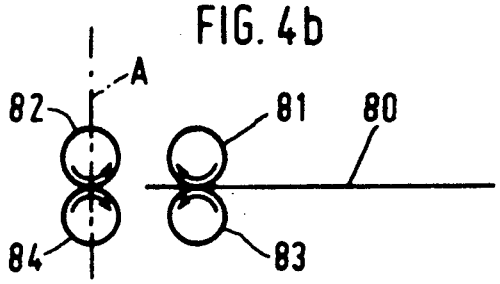
Figure 4D:
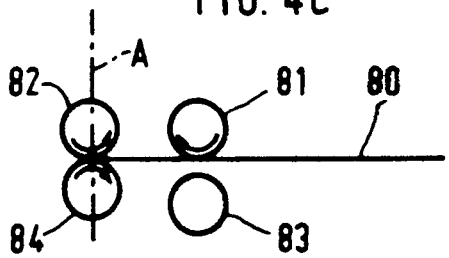
Figure 4E:
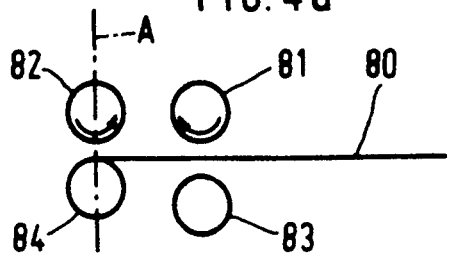

The sequence of the positioning cycle in the event of a copy sheet 80 deviating to the right from the ideal transport line A of the left hand longitudinal side is as shown in FIGS. 4*a*–4*e*. From the starting position of FIG. 4*a*, roller pair 74 is first brought into the operative position (FIG. 4*b*), but no force is yet exerted on the copy sheet 80 as a result. However, as soon as the roller pair 73 is in the operative position (as shown in FIG. 4*c*), copy sheet 80 is conveyed to the left as far as the nip of the roller pair 74. The copy sheet 80 thus positioned on line A is then released first by roller pair 73 and then by roller pair 74 so that the copy sheet 80 lays ready to be fed in the direction of conveyance.

Since in the positioning cycle shown in FIGS. 4*a*–4*e* the copy sheet 80 is conveyed only by roller pair 73, opening and closing of the two roller nips as described with respect to the positioning cycle of FIGS. 3*a*–3*e* can be applied simultaneously without any difficulty. The performance of the positioning cycles shown in FIGS. 3*a*–3*e* and 4*a*–4*e* can also be produced by an alternative embodiment of the positioning device according to the invention as shown diagrammatically in FIG. 5.

In this second embodiment the positioning roller pairs 73, 74 consist of rollers 100 and 101; 102 and 103 respectively. Rollers 100 and 102 are driven in the direction indicated by arrows and are together mounted in a yoke 104 shown diagrammatically which can be subjected to the action of actuating means.

Figure 5:
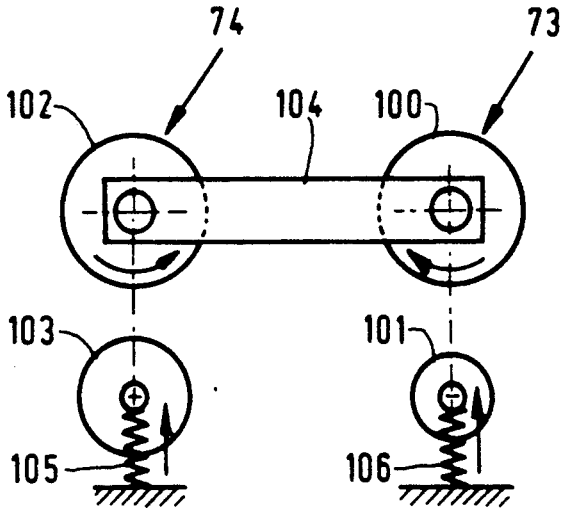

These actuating means, e.g., solenoids or pneumatic cylinders, can displace the assembly of rollers 100, 102 and yoke 104 between the inoperative position shown in FIG. 5 and an operative position in which roller 100 or 102, respectively, engages roller 101 or 103, respectively. Roller 101 or 103, respectively, is forced in the direction of the roller 100 or 102, respectively, by spring force, produced for example by compression spring 106 or 105, respectively, engaging the journal of roller 101 or 103, respectively. In addition, the diameter of roller 101 is smaller than the diameter of roller 103. As soon as the positioning cycle is started, the actuating means start to bring the rollers 100, 102 out of the inoperative position into the operative position.

In this moment, roller 102 first engages roller 103, whereupon on further movement against the compressive forces of spring 105, roller 103 is pressed downwards. A short time later roller 100 then engages roller 101 to bring this pair of rollers 73 into the operative position. The difference in normal force between the roller pairs 73 and 74 as described with respect to the first embodiment is produced in this second embodiment by compression springs 105 and 106 having a spring constant so selected that the required normal force (spring force) ratio is obtained.

Conversely, on movement of the assembly of the yoke 104 and rollers 100 and 102 from the operative to the inoperative position the engagement of the roller pair 73 is first interrupted (as a result of the smaller diameter of roller 101) and only then the disengagement of roller pair 74 occurs.

In this second described embodiment of the present invention, the positioning cycles can be carried out similarly as described with reference to FIGS. 3*a*–3*e* and FIGS. 4*a*–4*e* for the first described embodiment of the device according to the present invention. For both embodiments the bottom conveying means of the positioning device need not necessarily be constructed as rollers 83, 84; 101, 103. The construction would operate equally well with a biasing plate or biasing fingers instead of these rollers 83, 84; 101 and 103.

While a presently preferred embodiment of practicing the invention has been shown and described with particularity in connection with the accompanying drawings, the invention may be otherwise embodied within the scope of the following claims.

I claim:

1. A device for conveying sheets in a direction of sheet transport and for positioning said sheets comprising: a conveying means for conveying said sheets; an abutment means extending transversely of the direction of sheet transport; a positioning means for moving said sheets in a direction perpendicular to the direction of sheet transport in order to position one of the longitudinal sides of the sheets on an ideal transport line for said longitudinal side of said sheets, the positioning means being adapted to occupy an operative or inoperative position; and an actuating means for moving the positioning means between said operative position and said inoperative position; wherein said positioning means comprises: a first conveying device and a second conveying device, each said conveying device comprising two conveying members which form a transport nip extending parallel to said ideal transport line, at least one of said conveying members being formed by a roller, the transport nip of said first conveying device extending on and along said ideal transport line and said second conveying device being situated at some distance from said first conveying device within a zone of conveyance for said sheets; and a drive means enabling the roller or rollers of each conveying device to be so driven that each conveying device in its operative position exerts on said sheets a force which is directed towards the other conveying device.

2. A device according to claim 1, said device further including a biasing means for said conveying devices, said biasing means enabling said conveying members to be so pressed against one another in their operative position so as to create a normal force between said conveying members, such that a ratio between the normal force of the first conveying device and the normal force of the second conveying device is greater than or equal to two.

3. A device according to claim 1, wherein control means are provided with which the actuating means for moving the first conveying device and the second conveying device between the inoperative position and the operative position are so controlled that on changeover from said inoperative position to the operative position the conveying members of the first conveying device engage one another before engagement of the conveying members of the second conveying device, and on changeover from the operative position to the inoperative position the conveying members of the first conveying device are held in engagement with one another longer than the conveying members of the second conveying device.

4. A device according to claim 2 wherein control means are provided with which the actuating means for moving the first conveying device and the second conveying device between the inoperative position and the operative position are so controlled that on changeover from said inoperative position to the operative position the conveying members of the first conveying device engage one another before engagement of the conveying members of the second conveying device, and on changeover from the operative position to the inoperative position the conveying members of the first conveying device are held in engagement with one another longer than the conveying members of the second conveying device.

* * * * *